US007712848B1

(12) United States Patent
Frost-McKinley

(10) Patent No.: US 7,712,848 B1
(45) Date of Patent: May 11, 2010

(54) STORAGE DEVICE

(76) Inventor: Valerie S. Frost-McKinley, 7020 E. Friess Dr., Scottsdale, AZ (US) 85254

( * ) Notice: Subject to any disclaimer, the term of this patent is extended or adjusted under 35 U.S.C. 154(b) by 296 days.

(21) Appl. No.: 11/761,837

(22) Filed: Jun. 12, 2007

Related U.S. Application Data

(60) Provisional application No. 60/815,486, filed on Jun. 21, 2006.

(51) Int. Cl.
*A47B 85/00* (2006.01)

(52) U.S. Cl. ..... 312/240; 312/311

(58) Field of Classification Search ..... 312/240, 312/282, 291, 295, 298, 311, 313, 237, 230, 312/231, 233, 330.1; 220/819
See application file for complete search history.

(56) References Cited

U.S. PATENT DOCUMENTS

| | | | | | |
|---|---|---|---|---|---|
| 169,028 | A | * | 10/1875 | Nichols | 312/297 |
| 180,590 | A | * | 8/1876 | Hunter | 312/210.5 |
| 232,753 | A | * | 9/1880 | Peard | 312/230 |
| 275,882 | A | * | 4/1883 | Brownell | 312/231 |
| 367,239 | A | * | 7/1887 | Roth | 312/216 |
| 415,371 | A | * | 11/1889 | Smith | 312/230 |
| 446,647 | A | * | 2/1891 | Rankin | 312/295 |
| 658,999 | A | * | 10/1900 | Scannell | 312/209 |
| 927,625 | A | * | 7/1909 | Woldridge | 312/126 |
| 1,181,739 | A | * | 5/1916 | Clark | 312/233 |
| 1,471,757 | A | * | 10/1923 | Thiriot | 312/208.4 |
| 1,742,821 | A | * | 1/1930 | Nichols | 312/351 |
| 2,248,871 | A | * | 7/1941 | Howe | 108/166 |
| 2,582,575 | A | * | 1/1952 | Young | 434/419 |
| 2,700,587 | A | * | 1/1955 | Godfrey | 312/231 |
| 3,730,378 | A | * | 5/1973 | Albinson et al. | 220/819 |
| 3,904,003 | A | * | 9/1975 | Margerum | 190/11 |
| 4,310,207 | A | * | 1/1982 | Adams, Jr. | 312/314 |
| 4,804,877 | A | * | 2/1989 | Harwood | 312/114 |
| 6,578,938 | B2 | * | 6/2003 | Norman et al. | 312/290 |

* cited by examiner

*Primary Examiner*—James O Hansen
(74) *Attorney, Agent, or Firm*—Parsons & Goltry; Michael W. Goltry; Robert A. Parsons

(57) ABSTRACT

A storage device includes a base bounding a storage space and an opening into the storage space, a first panel pivotally attached to the base and a second panel pivotally attached to the first panel. The first and second panels pivot between a stored position including the first panel positioned against the base and the second panel positioned against the first panel, and a closed position including the first panel first panel positioned against the top of the base and the second panel received against the base overlying the opening into the storage space enclosing the storage space.

3 Claims, 5 Drawing Sheets

STORAGE DEVICE

FIELD OF THE INVENTION

The present invention relates to storage apparatus used for storing personal items and for reducing clutter.

BACKGROUND OF THE INVENTION

The need to reduce clutter in personal spaces has produced many innovative storage solutions, including a wide variety of closet organizers, storage containers, storage bins, compartmented storage assemblies, and the like. Because personal workspaces, desktops, dresser tops, and other similar areas are particularly prone to accumulate clutter, a variety of specialized tabletop storage devices have been developed that are designed to be placed on tabletops and used to hold and organize items such as jewelry, letters, pens and pencils, scissors, and the like. Although tabletop storage devices have enjoyed considerable attention by devoted artisans, existing tabletop storage devices have little or no utility apart from the primary functions of organizing and storing items, and are aesthetically unpleasing. Given these and other deficiencies in the art, there is a continuing and ongoing need for further improvement in the art of storage devices.

SUMMARY OF THE INVENTION

According to the invention, a storage device includes a base defining a top and an opposed bottom, a storage space formed between the top and the bottom, and an opening into the storage space formed between the top and the bottom. A first panel is pivotally attached to the base and to a second a second panel. The first and second panels pivot between a stored position including the first panel positioned against the top of the base and second panel positioned against the first panel, and a closed position including the first panel positioned against the top of the base and the second panel received against the base overlying the opening into the storage space. The first and second panels further pivot into a display position between the stored and closed positions including the first and second panels forming an A-shaped structure overlying the top of the base. A drawer is mounted to the base for movement between a first position in the storage space and a second position extending outwardly from the storage space through the opening. In the closed position of the first and second panels and the first position of the drawer the second panel encloses the drawer in the storage space.

According to the invention, a storage device includes a base defining a top and an opposed bottom, a storage space formed between the top and the bottom, and an opening into the storage space between the top and the bottom. A first panel has a first inner end and an opposed first outer end, a first inner face and an opposed first outer face. A second panel has a second inner end and an opposed second outer end, a second inner face and an opposed second outer face. A first hinged attachment is formed between the first inner end of the first panel and the base adjacent to the top, and a second hinged attachment is formed between the first outer end of the first panel and the second inner end of the second panel. The first and second panels are movable at the first and second hinged attachments between a stored position, a display position, and a closed position. The stored position includes the first inner face of the first panel positioned against the top, the inner face of the second panel positioned against the first outer face of the first panel, and the second outer face of the second panel facing outwardly forming a first display face. The closed position includes the first inner face of the first panel positioned against the top of the base, the second outer face of the second panel received against the base overlying the opening into the storage space, the second inner face of the second panel projecting outwardly forming a second display face, and the first outer face of the first panel facing outwardly forming a third display face. The display position includes the first and second panels forming an A-shaped structure overlying the top of the base including the second outer end of the second panel frictionally engaging the top of the base adjacent to the opening into the storage space, the second inner face of the second panel and the first outer face of the first panel each projecting upwardly and outwardly forming fourth and fifth display faces, respectively.

According to the invention, a storage device includes a base defining a top and an opposed bottom, a storage space formed between the top and the bottom, and an opening into the storage space between the top and the bottom. A drawer is mounted to the base for movement between a first position in the storage space and a second position extending outwardly from the storage space through the opening into the storage space. A first panel has a first inner end and an opposed first outer end, a first inner face and an opposed first outer face. A second panel has a second inner end and an opposed second outer end, a second inner face and an opposed second outer face. A first hinged attachment is formed between the first inner end of the first panel and the base adjacent to the top, and a second hinged attachment is formed between the first outer end of the first panel and the second inner end of the second panel. The first and second panels are movable at the first and second hinged attachments between a stored position, a display position, and a closed position. The stored position includes the first inner face of the first panel positioned against the top, the inner face of the second panel positioned against the first outer face of the first panel, and the second outer face of the second panel facing outwardly forming a first display face. In the second position of the drawer the closed position includes the first inner face of the first panel positioned against the top of the base, the second outer face of the second panel received against the base overlying the opening enclosing the storage space and the drawer positioned in the storage space in the second position of the drawer, the second inner face of the second panel projecting outwardly forming a second display face, and the first outer face of the first panel facing outwardly forming a third display face. The display position includes the first and second panels forming an A-shaped structure overlying the top of the base including the second outer end of the second panel frictionally engaging the top of the base adjacent to the opening into the storage space, the second inner face of the second panel and the first outer face of the first panel each projecting upwardly and outwardly forming fourth and fifth display faces, respectively.

According to the invention, a storage device includes a base defining a top and an opposed bottom, a storage space formed between the top and the bottom, and an opening into the storage space between the top and the bottom. Drawers are each mounted to the base for movement between a first position in the storage space and a second position extending outwardly from the storage space through the opening into the storage space. A first panel has a first inner end and an opposed first outer end, a first inner face and an opposed first outer face. A second panel has a second inner end and an opposed second outer end, a second inner face and an opposed second outer face. A first hinged attachment is formed between the first inner end of the first panel and the base adjacent to the top, and a second hinged attachment is formed between the first outer end of the first panel and the second inner end of the second panel. The first and second panels are movable at the first and second hinged attachments between a stored position, a display position, and a closed position. The stored position includes the first inner face of the first panel positioned against the top, the inner face of the second panel positioned against the first outer face of the first panel, and the second outer face of the second panel facing outwardly forming a first display face. With each of the drawers disposed in the first position in the storage space, the closed position includes the first inner face of the first panel positioned against the top of the base, the second outer face of the second panel received against the base overlying the opening enclosing the storage space and the drawers positioned in the storage space in the first positions of the drawers, the second inner face of the second panel projecting outwardly forming a second display face, and the first outer face of the first panel facing outwardly forming a third display face. The display position includes the first and second panels forming an A-shaped structure overlying the top of the base including the second outer end of the second panel frictionally engaging the top of the base adjacent to the opening into the storage space, the second inner face of the second panel and the first outer face of the first panel each projecting upwardly and outwardly forming fourth and fifth display faces, respectively.

BRIEF DESCRIPTION OF THE DRAWINGS

Referring to the drawings.

DETAILED DESCRIPTION OF PREFERRED EMBODIMENTS

Figure 1:
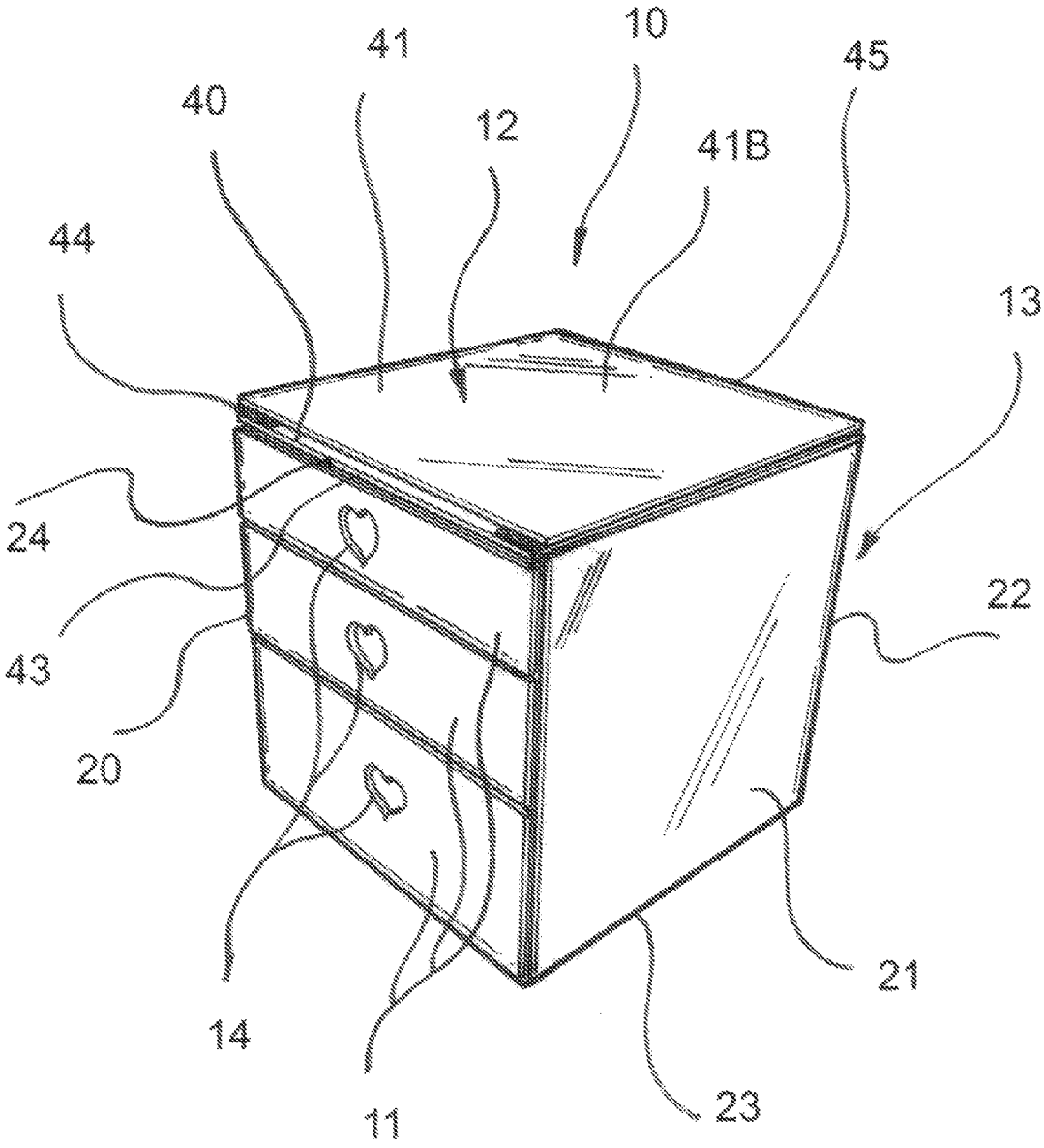
FIG. 1 is a perspective view of a storage device constructed and arranged in accordance with the principle of the invention, the storage device including drawers and a display structure maintained by a carcass, the display structure shown as it would appear in a stored position.

Turning now to the drawings, in which like reference characters indicate corresponding elements throughout the several views, attention is first directed to FIG. 1 in which there is seen a storage device 10 constructed and arranged in accordance with the principle of the invention including drawers 11 and a display structure 12 maintained by a carcass 13. Carcass 13 is the main supporting structure or base of storage device 10, and consists of opposed parallel sides 20 and 21, a back 22 affixed to and extending therebetween sides 20 and 21, a bottom 23 affixed to lower edges of sides 20 and 21 and back 22, and a top 24 affixed to upper edges of sides 20 and 21 and back 22.

Figure 3:
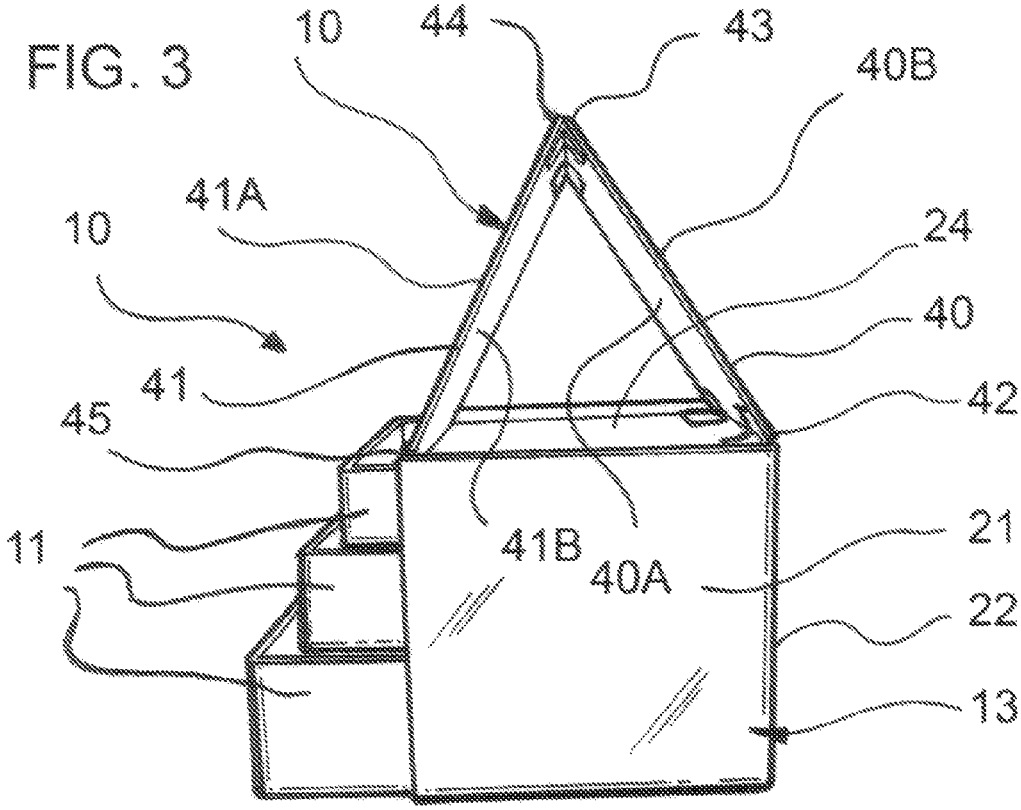
FIG. 3 is a side elevational view of the storage device of FIG. 2 with the display structure shown in the display position.
Figure 4:
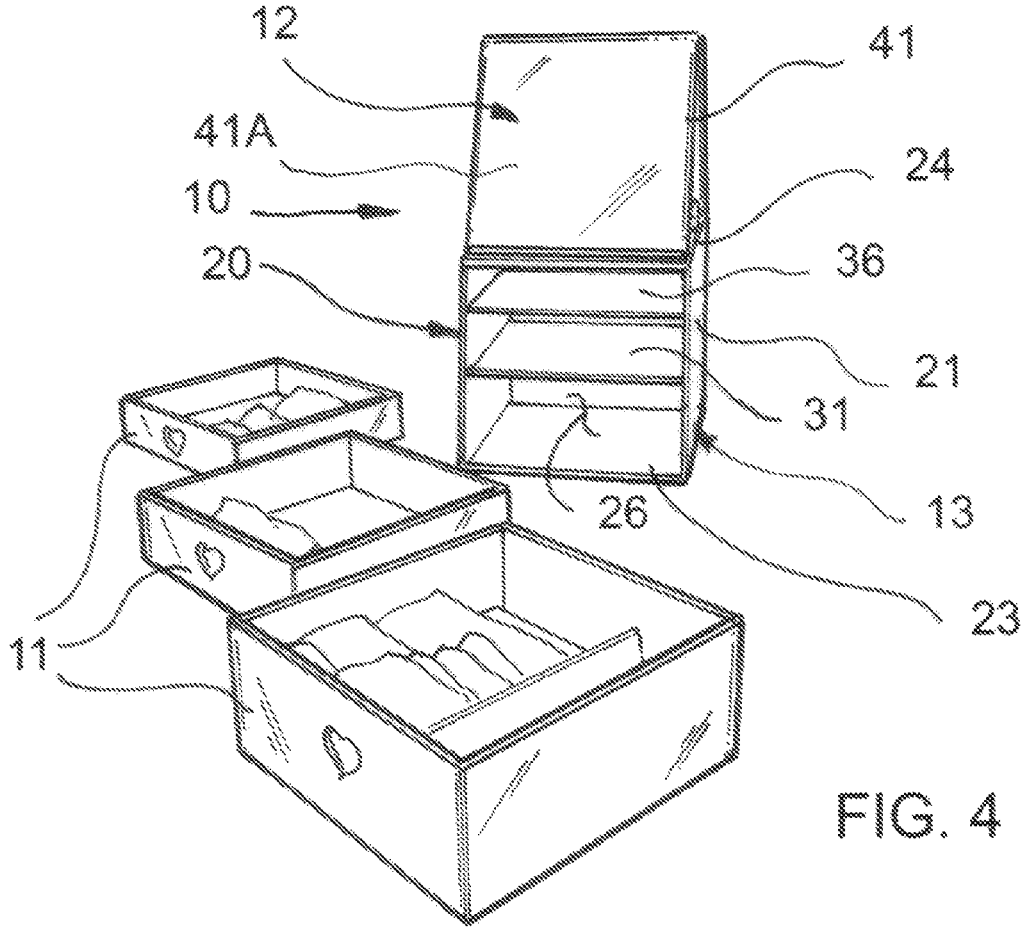
FIG. 4 is an exploded perspective view of the storage device of FIG. 1.
Figure 5:
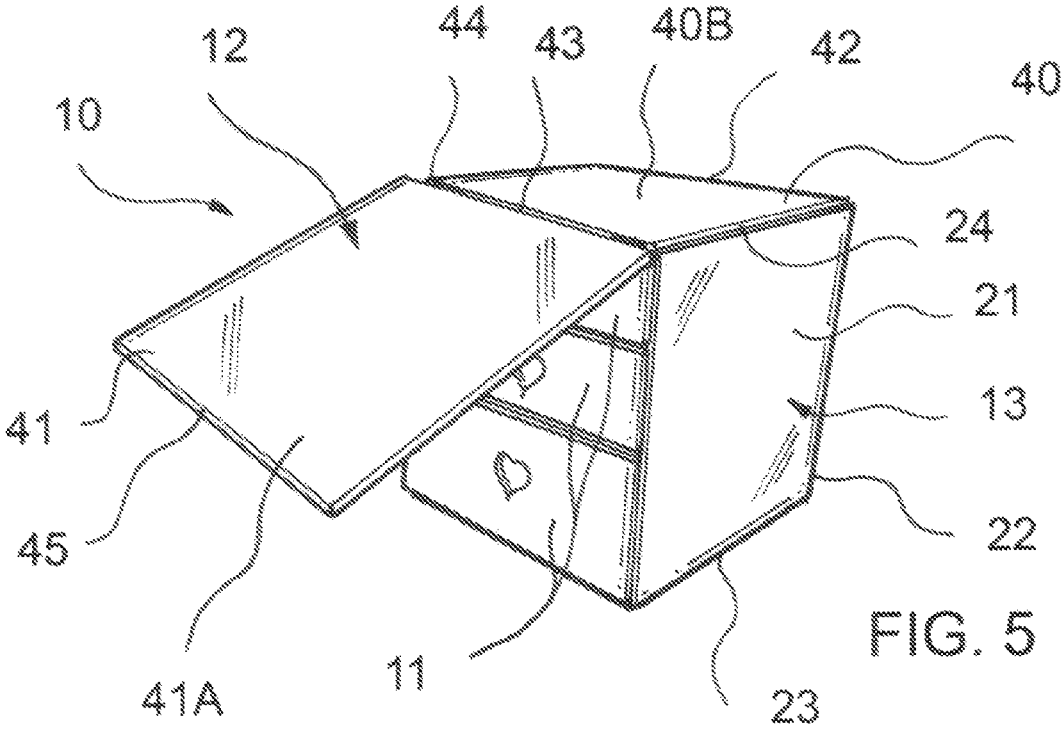
FIG. 5 is a perspective view of the storage device of FIG. 1 showing the display structure as it would appear disposed in an intermediate position between the display position of the display structure illustrated in FIG. 2 and a closed position of the display structure closing the storage device.

As seen in FIG. 4, forward edges of sides 20 and 21, bottom 23, and top 24 form an opening 26 into a storage space 27 in carcass 13, which is bound and defined by sides 20 and 21, back 22, bottom 23, and top 24. Spaced apart, parallel shelves 30 and 31 disposed in storage space 27 are affixed in place to inner surfaces of sides 20 and 21 and back 22. Shelves 30 and 31 extend between sides 20 and 21 dividing storage space 27 into three receiving areas for drawers 11, in which a first receiving area is defined between top 24 and shelf 30, a second receiving area is defined between shelves 30 and 31, and a third receiving area is defined between shelf 31 and bottom 23. Drawers 11 are received in the receiving areas, and are each movable relative to storage space 27 between a closed position in storage space 27 as shown in FIGS. 1 and 5, and an open position extending outwardly from storage space 27 through opening 26 as shown in FIGS. 2 and 3.

Carcass 13 and drawers 11 are fashioned of wood, plastic, metal, or other substantially rigid material or combination of materials. The construction and arrangement of carcass 13 and drawers 11 is generally representative of a typical chest-of-drawers, further details of which will readily occur to one having ordinary skill in the art and will not be discussed in further detail. In accordance with the skill attributed to the skilled artisan, it will be readily understood that drawers 11 can be mounted to carcass 13 in any conventional and well-known manner for allowing them to be moved between their closed and open positions relative to storage space 27, such as with rails, tongue-and-groove assemblies, etc. In their open positions, personal effects may be placed into drawers 11, or retrieved from drawers, after which drawers 11 may be closed for maintaining the items held thereby in storage space 27.

Drawers 11 are each fashioned with a decorative opening 14 extending through the front face thereof. Decorative openings 14, which are referenced in FIG. 1, provide not only a desired decorative affect, but also function as drawer pulls for allowing drawers 11 to be easily taken upon by hand and moved between their closed and open positions. Any suitable form of drawer pulls may be used with drawers 11 without departing from the invention, including knobs and the like or other selected form of drawer pull.

Figure 2:
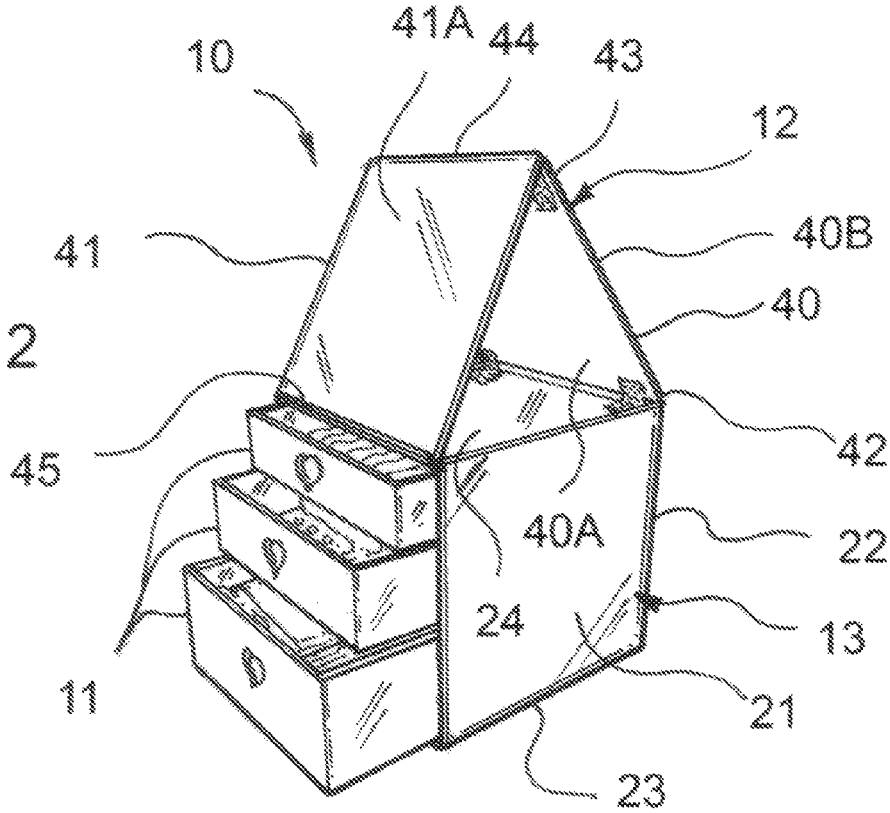
FIG. 2 is a perspective view of the storage device of FIG. 1 illustrating the drawers shown as they would appear open and the display structure shown in a display position.

Referring to FIGS. 2 and 3, display structure 12 consists of interconnected first and second panels 40 and 41. First and second panels 40 and 41 are flat and broad, and are substantially coextensive relative to each other, and are each of them substantially coextensive relative to top 24. First panel 40 has an inner end 42 and an opposing outer end 43, and second panel 41 has an inner end 44 and an opposing outer end 45. First panel 40 has opposing inner and outer faces 40A and 40B, and second panel has opposing inner and outer faces 41A and 41B. Inner end 42 of first panel 40 is hingedly attached to carcass 13 substantially at a juncture between the upper edge of back 22 and the rear edge of top 24, and outer end 43 of first panel 40 is, in turn, hingedly attached to inner end 44 of second panel 41, in accordance with the principle of the invention. The hinged attachment between first panel 40 and carcass 13 and the hinged attachment between first panel 40 and second panel 41 permit the pivotal adjustment of display structure between stored, display, and closed positions.

FIG. 1 depicts display structure 12 as it would appear in a stored position, which consists of inner face 40A of first panel 40 positioned flat atop top 24, and inner face 41A of second panel 41, in turn, positioned flat atop outer face 40B of first panel 40. In the stored position, outer face 41B of second panel 41 faces outwardly, and is capable of accommodating personal items set thereon, such as jewelry, pictures, etc. According to the principle of the invention, outer face 41B can be configured with a picture frame or holder, for holding and displaying a selected picture. Alternatively, a picture or photograph or other selected item to be displayed may simply be mounted to outer face 41B constituting a supporting display surface.

Display structure 12 is moveable at the hinged attachment points between first panel 40 and carcass 13 and between second panel 41 and first panel 40 from the stored position as shown in FIG. 1 to a display position as shown in FIGS. 2-4. To move display structure 12 from the stored position to the display position, first panel 40 is pivoted relative to carcass 13 at the hinged attachment therebetween upwardly away from carcass 13, and second panel 41 is pivoted relative to first panel 40 at the hinged attachment therebetween away from first panel 41, thereby resulting in first and second panels 40 and 41 cooperating together forming an A-shaped structure atop top 24 defining the display position of display structure 12, according to the principle of the invention. To secure display structure 12 in the display position, outer end 45 of second panel is set onto top 24 adjacent to the outer edge of top 24 defining, in part, opening 26 into storage space 27, in which the frictional engagement between outer end 45 of second panel 41 and top 24 secures display structure 12 in the display position, in accordance with the principle of the invention. If desired, top 24 can be configured with an abutment surface, such as a raised feature defining a raised abutment surface, or a recess defining a recessed abutment surface, against which outer end 45 of second panel 41 may be positioned for securing display structure 12 in its display position.

In the display position of display structure 12, inner face 41A projects forwardly toward drawers 11, and provides a unique display surface in conjunction with the remaining structure features of storage device 10. According to the principle of the invention, inner face 41A can be configured with a picture frame or holder, for holding and displaying a selected picture in the display position of display structure. Alternatively, a picture or photograph or other selected item to be displayed may simply be mounted to inner face 41A constituting a supporting display surface.

Figure 6:
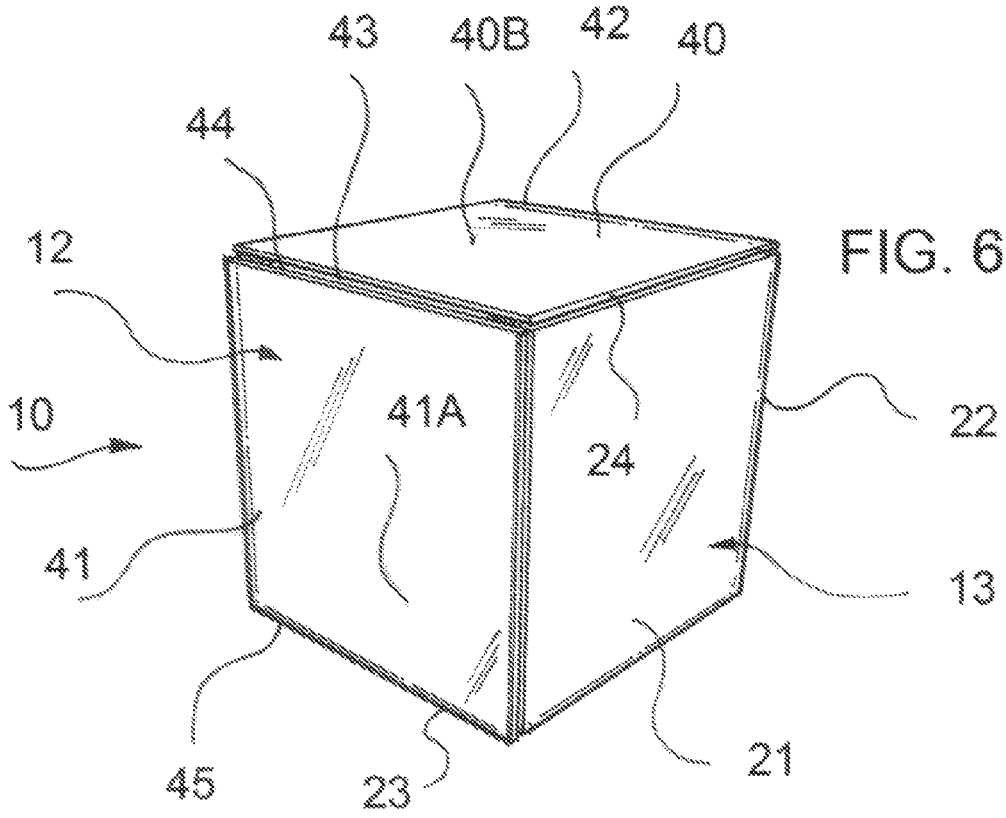
FIG. 6 is a perspective view of the storage device of FIG. 1 showing the display structure at it would appear in a closed position closing the storage device.

From the display position, display structure 12 can be moved into a closed position closing storage device 10 in the closed position of drawers 11, in accordance with the principle of the invention as shown in FIG. 6. To move display structure 12 into the closed position from the display position, drawers 11 are positioned in their closed positions and display structure 12 is pivoted disengaging outer end 45 of second panel from top 24, and second panel 41 is pivoted somewhat outwardly away from inner face 40A of first panel 40, and first panel 40 is pivoted relative to carcass 13 at the hinged attachment therebetween downwardly locating inner face 40A of first panel 40 flat atop top 24 as shown in FIG. 5. At this point, second panel 41 is pivoted downwardly toward drawers 11 bringing outer face 41B against the front end of carcass 13 overlying and concealing drawers 11 at opening 26 into storage space 27 as shown in FIG. 6 thereby closing storage device 10, in accordance with the principle of the invention. The foregoing operation need only be reversed for placing display structure 12 back to the display position, and from the display position to the stored position. It is to be understood that display structure 12 can be moved between the stored and closed positions without placing it into the display position between the stored and closed positions.

In the closed position of display structure 12, inner face 41A projects forwardly away from drawers 11, and, as in the display position of display structure 12, provides a unique display surface in conjunction with the remaining structure features of storage device 10. According to the principle of the invention, inner face 41A can be configured with a picture frame or holder, for holding and displaying a selected picture in the closed position of display structure. Alternatively, a picture or photograph or other selected item to be displayed may simply be mounted to inner face 41A constituting a supporting display surface.

In the closed position of display structure 12, outer face 40B of first panel 41 faces outwardly, and is capable of accommodating personal items set thereon, such as jewelry, pictures, etc. According to the principle of the invention, outer face 40B can be configured with a picture frame or holder, for holding and displaying a selected picture. Alternatively, a picture or photograph or other selected item to be displayed may simply be mounted to outer face 40B constituting a supporting display surface.

Figure 7:
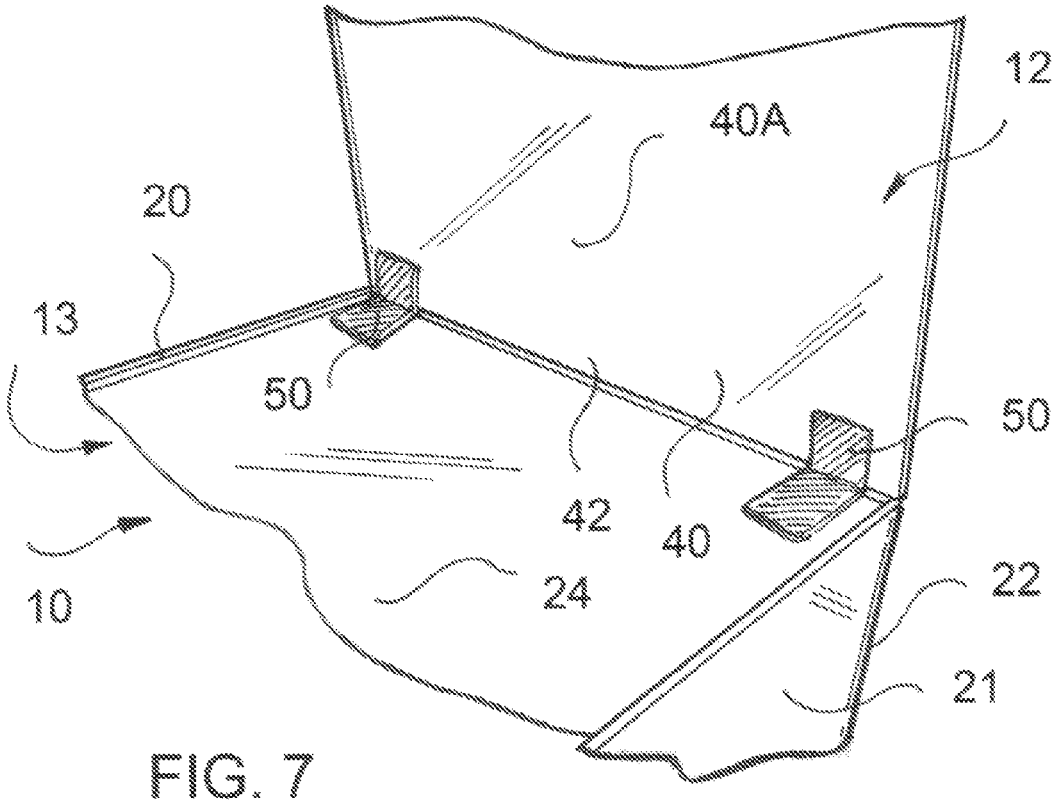
FIG. 7 is an enlarged, fragmented perspective view of the storage device of FIG. 1 illustrating a hinged attachment between the display structure and the carcass.

Referring to FIG. 7, opposed strips 50 of flexible material concurrently affixed, such as with glue, to top 24 of carcass 13 and inner end 42 of first panel 40 provide the hinged attachment between first panel 40 and carcass 13. Strips 50 are fashioned of cloth, elastomer, or other flexible material or combination of materials. Two strips at either side of inner end 42 of first panel 40 are used in the immediate embodiment, and more can be used, if desired. Furthermore, one broad strip of material can be used for providing the hinged attachment between first panel 40 and carcass 13.

Figure 8:
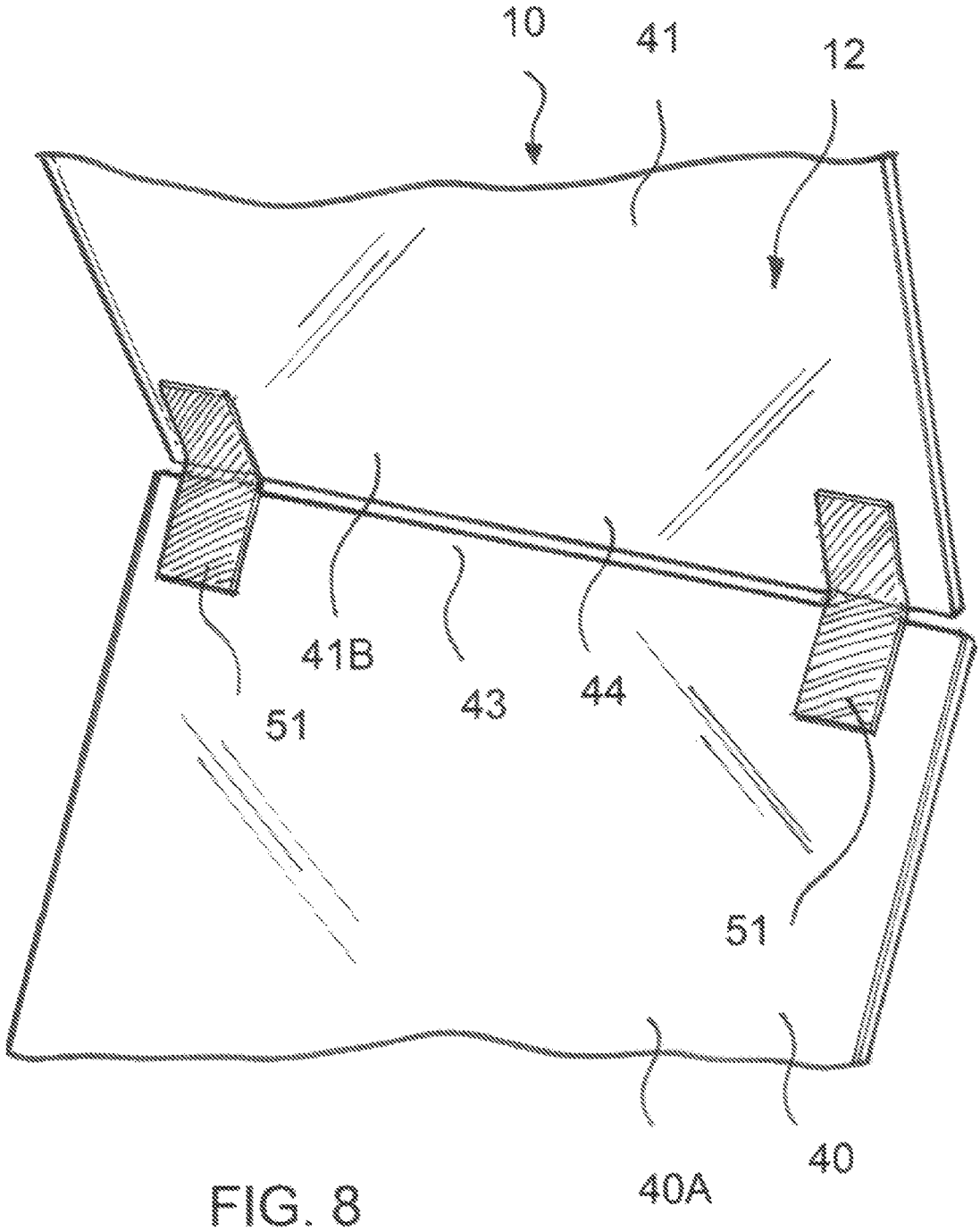
FIG. 8 is an enlarged, fragmented perspective view of a hinged attachment between first and second panels of the display structure of the storage device of FIG. 1.

Referring to FIG. 8, opposed strips 51 of flexible material concurrently affixed, such as with glue, to outer end 43 of first panel 40 and inner end 44 of second panel 41 provide the hinged attachment between first and second panels 40 and 41. Strips 51 are fashioned of cloth, elastomer, or other flexible material or combination of materials. Two strips at either side of first and second panels 40 and 41 are used in the immediate embodiment, and more can be used, if desired. Furthermore, one broad strip of material can be used for providing the hinged attachment between first and second panels 40 and 41*s*.

Although strips of material are used to provide the hinged attachment between first panel 40 and carcass 13, and between first and second panels 40 and 41, those having regard for the art will readily appreciate that any suitable form of hinge structure can be used between first panel 40 and carcass 13 and between first and second panels 40 and 41 without departing from the invention.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A storage device, comprising:

a base defining a top and an opposed bottom, a storage space formed between the top and the bottom, and an opening into the storage space between the top and the bottom;

a first panel having a first inner end and an opposed first outer end, a first inner face and an opposed first outer face;

a second panel having a second inner end and an opposed second outer end, a second inner face and an opposed second outer face;

a first hinged attachment formed between the first inner end of the first panel and the base adjacent to the top, and a second hinged attachment formed between the first outer end of the first panel and the second inner end of the second panel;

the first and second panels movable at the first and second hinged attachments between:

a stored position comprising the first inner face of the first panel positioned against the top, second the inner face of the second panel positioned against the first outer face of the first panel, and the second outer face of the second panel facing outwardly forming a first display face;

a closed position comprising the first inner face of the first panel positioned against the top of the base, the second outer face of the second panel received against the base overlying the opening into the storage space, the second inner face of the second panel projecting outwardly forming a second display face, and the first outer face of the first panel facing outwardly forming a third display face; and a display position between the stored and closed positions comprising the first and second panels forming an A-shaped structure overlying the top of the base including the second outer end of the second panel frictionally engaging the top of the base adjacent to the opening into the storage space, the second inner face of the second panel and the first outer face of the first panel each projecting upwardly and outwardly forming fourth and fifth display faces, respectively.

2. A storage device, comprising:

a base defining a top and an opposed bottom, a storage space formed between the top and the bottom, and an opening into the storage space between the top and the bottom;

a drawer mounted to the base for movement between a first position in the storage space and a second position extending outwardly from the storage space through the opening into the storage space;

a first panel having a first inner end and an opposed first outer end, a first inner face and an opposed first outer face;

a second panel having a second inner end and an opposed second outer end, a second inner face and an opposed second outer face;

a first hinged attachment formed between the first inner end of the first panel and the base adjacent to the top, and a second hinged attachment formed between the first outer end of the first panel and the second inner end of the second panel;

the first and second panels movable at the first and second hinged attachments between:

a stored position comprising the first inner face of the first panel positioned against the top, second the inner face of the second panel positioned against the first outer face of the first panel, and the second outer face of the second panel facing outwardly forming a first display face; and in the second position of the drawer;

a closed position comprising the first inner face of the first panel positioned against the top of the base, the second outer face of the second panel received against the base overlying the opening enclosing the storage space and the drawer positioned in the storage space in the first position of the drawer, the second inner face of the second panel projecting outwardly forming a second display face, and the first outer face of the first panel facing outwardly forming a third display face; and a display position between the stored and closed positions comprising the first and second panels forming an A-shaped structure overlying the top of the base including the second outer end of the second panel frictionally engaging the top of the base adjacent to the opening into the storage space, the second inner face of the second panel and the first outer face of the first panel each projecting upwardly and outwardly forming fourth and fifth display faces, respectively.

3. A storage device, comprising:

a base defining a top and an opposed bottom, a storage space formed between the top and the bottom, and an opening into the storage space between the top and the bottom;

drawers each mounted to the base for movement between a first position in the storage space and a second position extending outwardly from the storage space through the opening into the storage space;

a first panel having a first inner end and an opposed first outer end, a first inner face and an opposed first outer face;

a second panel having a second inner end and an opposed second outer end, a second inner face and an opposed second outer face;

a first hinged attachment formed between the first inner end of the first panel and the base adjacent to the top, and a second hinged attachment formed between the first outer end of the first panel and the second inner end of the second panel;

the first and second panels movable at the first and second hinged attachments between:

a stored position comprising the first inner face of the first panel positioned against the top, second the inner face of the second panel positioned against the first outer face of the first panel, and the second outer face of the second panel facing outwardly forming a first display face;

a display position comprising the first and second panels forming an A-shaped structure overlying the top of the base including the second outer end of the second panel frictionally engaging the top of the base adjacent to the opening into the storage space, the second inner face of the second panel and the first outer face of the first panel each projecting upwardly and outwardly forming second and third display faces, respectively; and in the first positions of the drawers;

a closed position comprising the first inner face of the first panel positioned against the top of the base, the second outer face of the second panel received against the base overlying the opening into the storage space enclosing the storage space and the drawers positioned in the storage space, the second inner face of the second panel projecting outwardly forming a fourth display face, and the first outer face of the first panel facing outwardly forming a fifth display face.

* * * * *